US006343130B2

(12) United States Patent
Yamazaki

(10) Patent No.: US 6,343,130 B2
(45) Date of Patent: Jan. 29, 2002

(54) STEREOPHONIC SOUND PROCESSING SYSTEM

(75) Inventor: Yasushi Yamazaki, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/030,166

(22) Filed: Feb. 25, 1998

(30) Foreign Application Priority Data

Jul. 3, 1997 (JP) ..... 9-178343

(51) Int. Cl.[7] ..... H04R 5/02
(52) U.S. Cl. ..... 381/309; 381/310; 381/123
(58) Field of Search ..... 381/1, 17, 18, 381/19, 300, 303, 304, 305, 309, 310, 26, 74, FOR 125, FOR 165, 123; 700/94

(56) References Cited

U.S. PATENT DOCUMENTS 5,173,944 A * 12/1992 Begault ..... 381/17
5,208,860 A * 5/1993 Lowe et al. ..... 381/17
5,438,623 A * 8/1995 Begault ..... 381/17
5,440,639 A * 8/1995 Suzuki et al. ..... 381/17
5,581,618 A * 12/1996 Satoshi et al. ..... 381/17
5,598,478 A * 1/1997 Tanaka et al. ..... 381/17
5,659,619 A * 8/1997 Abel ..... 381/1
5,729,612 A * 3/1998 Abel et al. ..... 381/17
5,774,556 A * 6/1998 Lowe et al. ..... 381/17
5,946,400 A * 8/1999 Matsuo ..... 381/17
5,974,152 A * 10/1999 Fujinami ..... 381/300

* cited by examiner

*Primary Examiner*—Xu Mei
(74) *Attorney, Agent, or Firm*—Staas & Halsey LLP

(57) ABSTRACT

A stereophonic sound processing system for localizing a sound image at desired locations using devices including a headphone and a speaker, includes a processing unit for generating stereophonic sound on the basis of an input signal. The processing unit includes: a plurality of stereophonic filter units each including an FIR filter for processing an input signal; a selecting unit for selecting one of the plurality of stereophonic filter units in accordance with a desired factor; wherein the processing unit controls the selected stereophonic filter unit so as to generate stereophonic sound on the basis of a processed result supplied by the selected stereophonic filter unit.

17 Claims, 21 Drawing Sheets

FIG. 6 PRIOR ART

FILTER TABLE 1

| | |
|---|---|
| 0° | FACTOR. . . . |
| 5° | FACTOR. . . . |
| 10° | FACTOR. . . . |
| . . . | . . . . . |
| 360° | FACTOR. . . . |

FIG. 11

FILTER TABLE 1

| | |
|---|---|
| 0° | FACTOR. . . . |
| 5° | FACTOR. . . . |
| 10° | FACTOR. . . . |
| . . . | . . . . . |
| 360° | FACTOR. . . . |

LOW SPEED/HIGH PERFORMANCE

FILTER TABLE 2

| | |
|---|---|
| 0° | FACTOR. . |
| 5° | FACTOR. . |
| 10° | FACTOR. . |
| . . . | . . . . . |
| 360° | FACTOR. . |

HIGH SPEED/LOW PERFORMANCE

FIG. 17

| CPU PERFORMANCE | CPU OCCUPANCY RATIO | NUMBER OF SOUND SOURCES | ORDER OF FILTER | |
|---|---|---|---|---|
| Pentium 120MHz | 20% | 1 | 20TH ORDER | DEFAULT |
| | | 2 | 10TH ORDER | DECREASE IN PROCESSING VOLUME DUE TO INCREASE IN NUMBER OF SOUND SOURCES |
| Pentium 75MHz | 10% | 1 | 10TH ORDER | DECREASE IN PROCESSING VOLUME DUE TO INCREASE OF OTHER PROCESSES |
| | 20% | 1 | 12TH ORDER | DECREASE IN PROCESSING VOLUME DUE TO DROP IN CPU PERFORMANCE |

STEREOPHONIC SOUND PROCESSING SYSTEM

BACKGROUND OF THE INVENTION

1. Field of the Invention

The present invention generally relates to stereophonic sound processing systems for localizing a sound image at a desired location in the ambience of a listener and, more particularly, to a stereophonic sound processing system comprising a plurality of stereophonic filter means having different processing capabilities and performance so that one of the plurality of stereophonic filter means is selected as required.

Recently, with an increasing use of multimedia, the number of personal computers equipped with audio output is increasing. Associated with this, a large number of multimedia products such as games are produced, providing stereophonic sound when such a product is run on a personal computer. As the performance of a CPU and the like is rapidly improving, it has become possible to generate stereophonic sound in response to an operation of a user. There is a need for a stereophonic sound processing system capable of appropriately performing a stereophonic sound process so as to enable the user to enjoy the image and the associated stereophonic sound simultaneously without the user being aware of a drop in the processing speed.

It is also to be noted that an increasing number of multimedia products are created using a personal computer. Accordingly, there is a need for a system that can efficiently produce stereophonic sound using a personal computer.

2. Description of the Related Art

FIG. 1 shows a principle of a stereophonic sound process. For example, a microphone is attached to both ears of a dummy head 2 located in an anechoic room so as to pick up sound from a sound source 1. A transfer function Sly between a sound source in a desired orientation and a left ear, and a transfer function Sr. between the same sound source and a right ear are obtained using a setup as illustrated in FIG. 1. In reproduction, an input signal from a sound source 3 is processed using processing devices 4 and 5 provided with the transfer functions Sly and Sr., respectively, so that a user can hear stereophonic sound. A process is also needed for canceling characteristics of an output device such as a headphone or a speaker. More specifically, the characteristics of a headphone or a speaker are canceled using a processing device 6 ($H^{-1}$).

FIG. 2 is a graph showing a transfer function measured between a sound source 30° displaced to the front left of a listener and a left ear of the listener, using a setup as shown in FIG. 1. FIG. 3 is a graph showing a frequency characteristic of the transfer function of FIG. 2. FIG. 4 is a block diagram showing how the transfer function of FIG. 2 is represented by a finite impulse response (FIR) filter or a infinite impulse response (IIR) filter normally having a total of several hundred taps. Cancellation of the characteristics of the output device is also implemented by a filter. In other words, the processing devices 4, 5 and 6 are implemented by a FIR filter or an IIR filter.

FIG. 5 is a block diagram showing a construction of a stereophonic sound processing system according to the related art. Transfer functions that correspond to a variety of locations of a sound source are obtained using a setup as shown in FIG. 1. In generating stereophonic sound, an input signal is processed using the transfer function that corresponds to the localization of a sound image. More specifically, a filter factor to be applied to a filter 12 is selected by a filter factor selection unit 11 depending on the localization of the sound image. The filter factor selection unit 11 may refer to a filter table storing filter factors that correspond to different orientations of the sound source. FIG. 6 shows such a filter table. For example, the table may contain a filter factor that corresponds to the transfer function occurring when the sound source is located to the front of the listener, a filter factor that corresponds to the transfer function occurring when the sound source is located 30° to the left of the listener, . . . a filter factor that corresponds to the transfer function occurring when the sound source is located 30° to the right of the listener, etc.

FIG. 7 is a flowchart showing an operation of the stereophonic sound processing system according to the related art. In step ST1, the stereophonic sound processing system reads a signal from a sound source. In step ST2, localization of the sound source is read. In step ST3-1, a filter factor that corresponds to the localization is selected by referring to the filter table. In step ST3-2, a filter process is executed. In step ST4, the signal subjected to the filter process is output as stereophonic data, thus completing the stereophonic sound process.

As shown in FIG. 5, the stereophonic sound processing system according to the related art is provided with a sound source and localization of a sound image. The stereophonic sound processing system then subjects the input signal to a stereophonic sound process so as to output stereophonic data. The stereophonic sound process requires a filter having a total of several hundred taps so that dedicated hardware is normally used. In an ordinary personal computer, a general-purpose CPU is used to execute the stereophonic sound process. The dedicated hardware is characterized by high performance and large processing volume. The personal computer is characterized by low processing volume and slightly poor quality of localization due to a simpler process. The dedicated hardware is available as a high-end product for professionals and the software process is commercialized as personal-use software.

Thanks to the recent improvement in CPU performance, it has become possible to implement a high-precision stereophonic sound process only by software. More specifically, it has become easy to perform a high-precision stereophonic sound process by running applications intended for multimedia production on a personal computer as well as on a workstation or a large-scale computer. While high-precision stereophonic sound may be preferable in some types of usage and applications, it may be preferable to produce not so high-precision stereophonic sound in other types of usage and applications. For example, a producer of a stereophonic sound product may be required to produce predetermined stereophonic sound in a given period of time, irrespective of the performance of a CPU. In other words, the processing volume may have to be reduced. In such a case, efficient stereophonic sound production is possible by sacrificing the precision so that the processing time is maintained constant. While a stereophonic sound production system has been hitherto limited to either a high-precision specification or a low-precision specification, it is desirable that advantages of both specifications can be selected on a case-by-case basis.

In another aspect, it is of course desirable that high-precision stereophonic sound and low-precision stereophonic sound can be appropriately selected so as to satisfy an end user enjoying stereophonic sound by running an interactive application such a game on a personal computer.

SUMMARY OF THE INVENTION

Accordingly, a general object of the present invention is to provide a stereophonic sound processing system in which the aforementioned desired improvements are made.

Another and more specific object is to provide a stereophonic sound processing system for reproducing stereophonic sound using a personal computer adapted for multimedia such that stereophonic sound most appropriate for the performance of a processing device used in the personal computer and for the requirement of a user is generated. It is to be appreciated that, with the present invention, a production application or an end-user application can be compatible with both high-precision stereophonic sound and low-precision stereophonic sound.

The aforementioned objects can be achieved by a stereophonic sound processing system for localizing sound image at desired locations using devices including a headphone and a speaker, comprising processing means for generating stereophonic sound on the basis of an input signal; said processing means further comprising: a plurality of stereophonic filter means each comprising an FIR filter for processing an input signal; selecting means for selecting one of said plurality of stereophonic filter means in accordance with a desired factor; wherein said processing means controls the selected stereophonic filter means so as to generate stereophonic sound on the basis of a processed result supplied by the selected stereophonic filter means.

The aforementioned objects can also be achieved by a computer-readable recording medium storing a stereophonic sound processing program for localizing sound image at desired locations using devices including a headphone and a speaker, said stereophonic sound processing program comprising processing means for generating stereophonic sound on the basis of an input signal; said processing means further comprising: a plurality of stereophonic filter means each comprising one of an FIR filter and an IIR filter for processing an input signal; selecting means for selecting one of said plurality of stereophonic filter means in accordance with a desired factor; wherein said processing means controls the selected stereophonic filter means so as to generate stereophonic sound on the basis of a processed result supplied by the selected stereophonic filter means.

According to the present invention, stereophonic sound can be produced in accordance with requirements of a producer of the stereophonic sound or an end user.

BRIEF DESCRIPTION OF THE DRAWINGS

Other objects and further features of the present invention will be apparent from the following detailed description when read in conjunction with the accompanying drawings, in which:

FIG. 6 shows a filter table;

FIG. 11 shows a filter table according to the present invention;

FIG. 17 is a table showing filter tap numbers adapted for different CPU processing capabilities;

DETAILED DESCRIPTION OF THE EMBODIMENTS

Figure 8:
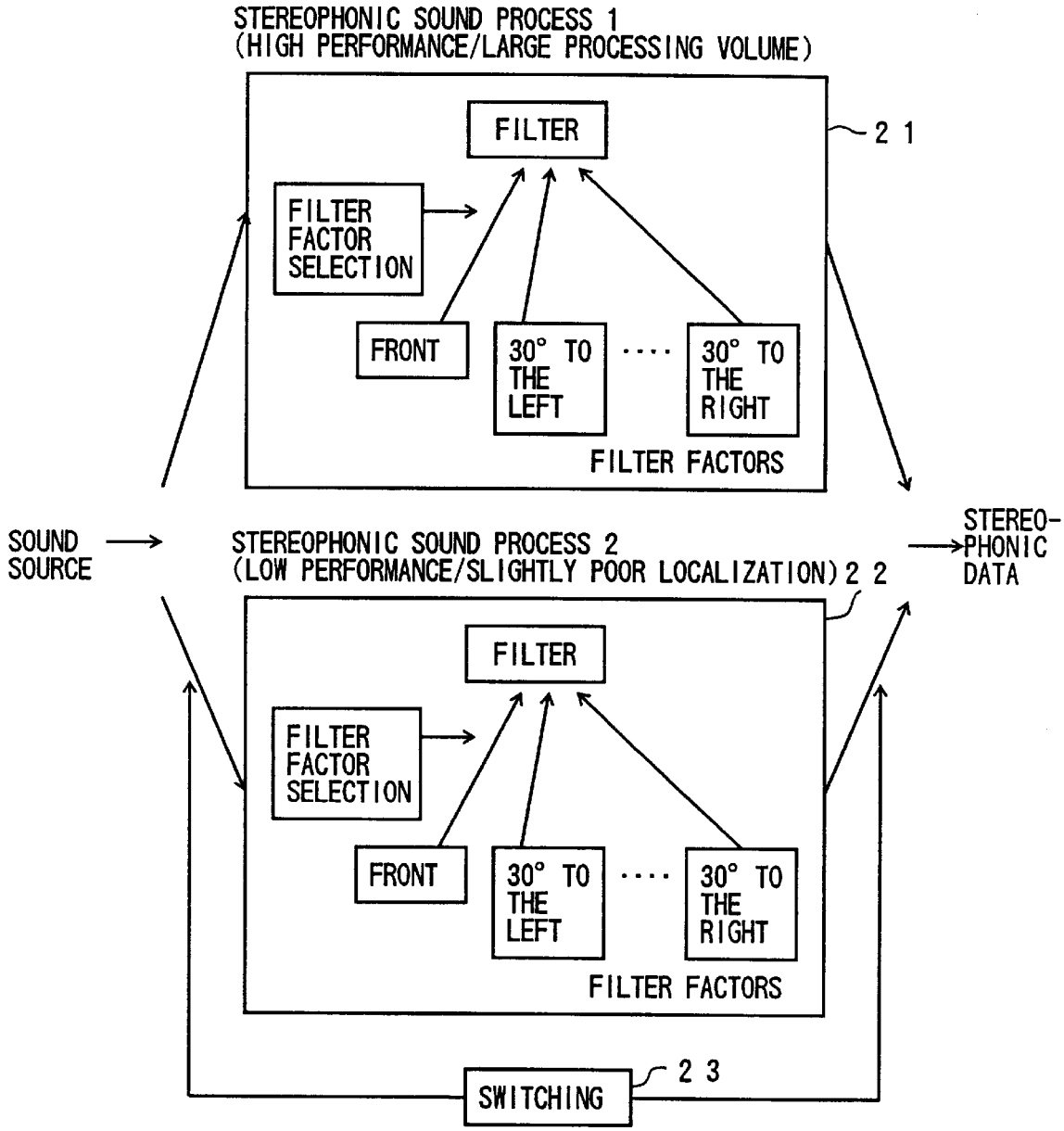
FIG. 8 shows an operating principle and construction of the stereophonic sound processing system according to the present invention.

FIG. 8 shows an operating principle and construction of the stereophonic sound processing system according to the present invention. The stereophonic sound processing system switches between high-precision stereophonic filter means 21 and low-precision stereophonic filter means 22. Each of the high-precision stereophonic filter means 21 and the low-precision stereophonic filter means 22 is constructed in a manner similar to the stereophonic sound processing system according to the related art, and the description of the means 21 and 22 will be omitted. The high-precision stereophonic filter means 21, the low-precision stereophonic filter means 22 and a switching unit 23 are controlled by a CPU (not shown). The high-precision stereophonic filter means 21 uses a filter table 1 as shown in FIG. 11 and the low-precision stereophonic filter means 22 uses a filter table 2 as shown in FIG. 11. Difference between the performance of the high-precision stereophonic filter means 21 and the low-precision stereophonic filter means 22 can be controlled by, for example, changing the number of taps in the filter. The filter may be an FIR filter or an IIR filter.

Figure 1:
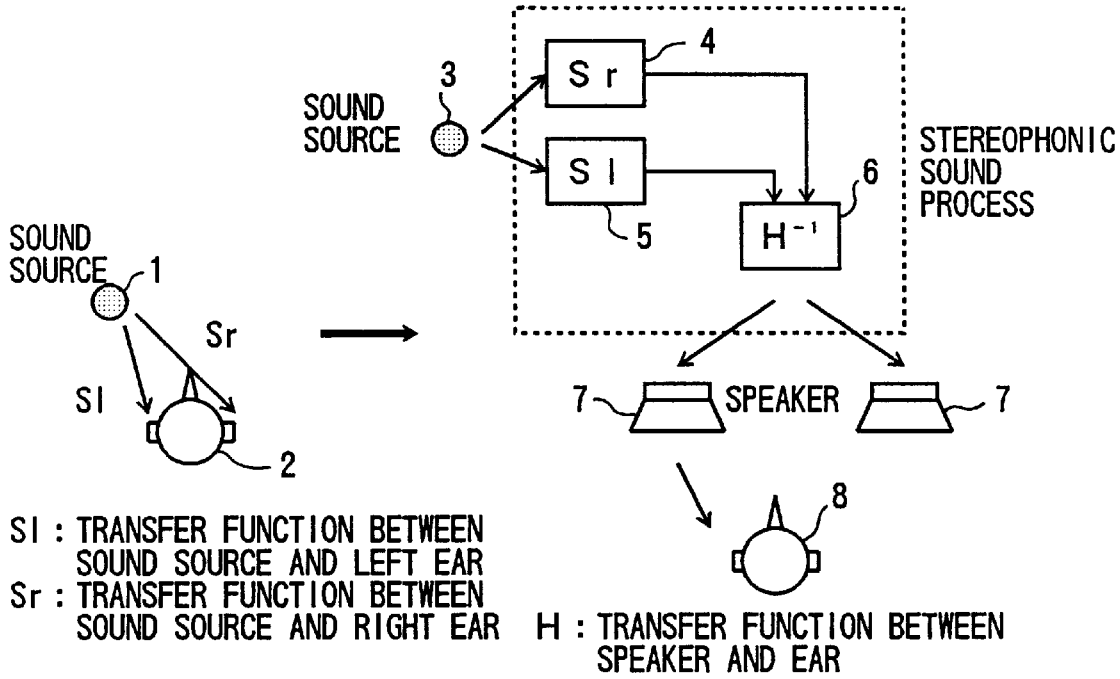
FIG. 1 PRIOR ART
FIG. 1 shows a principle of a stereophonic sound process.
Figure 2:
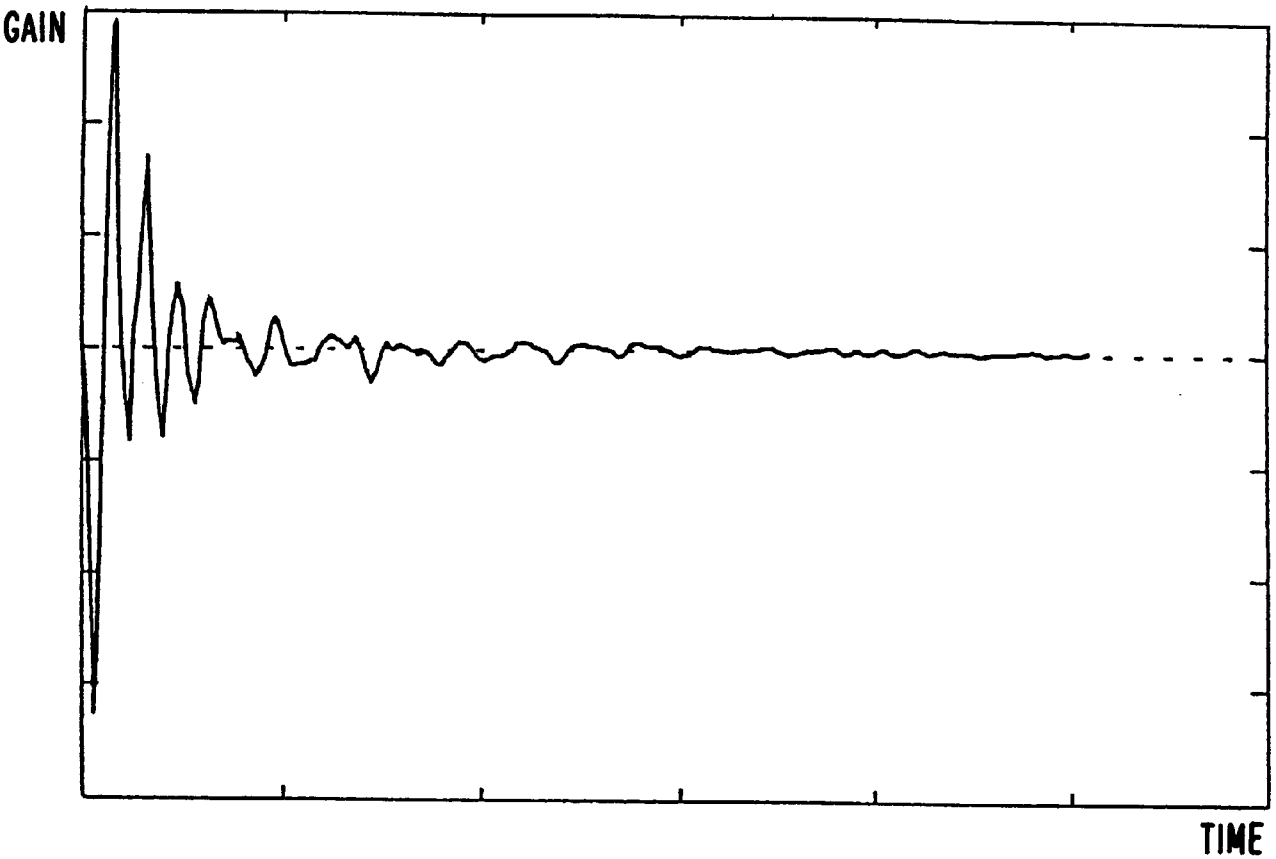
FIG. 2 PRIOR ART
FIG. 2 is a graph showing a transfer function measured between a sound source 30° displaced to the front left of a listener and a left ear of the listener, using a setup as shown in FIG. 1.
Figure 3:
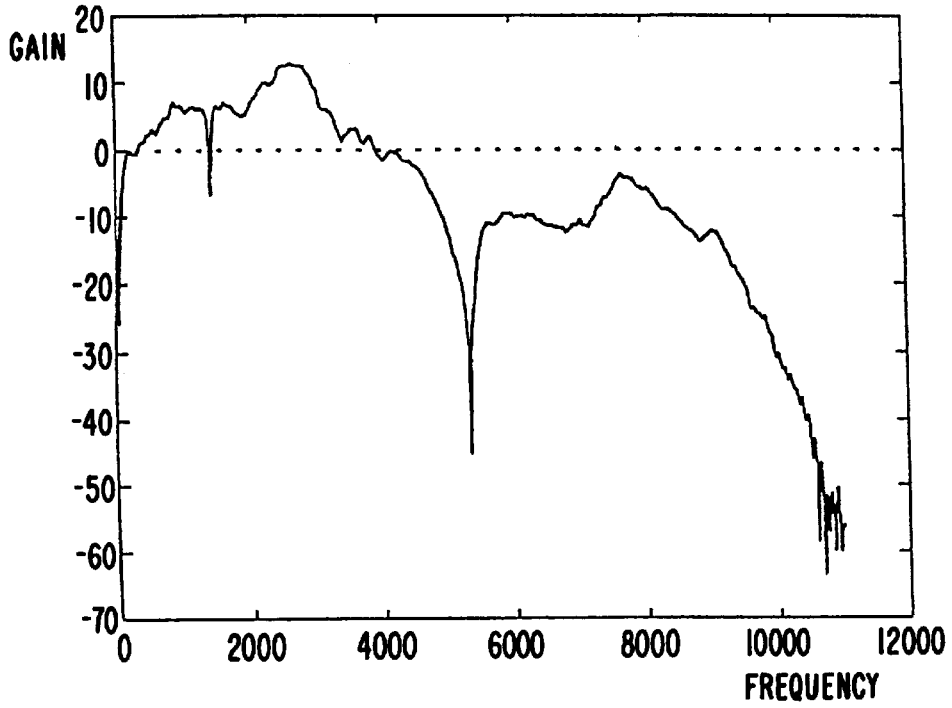
FIG. 3 PRIOR ART
FIG. 3 is a graph showing a frequency characteristic of the transfer function of FIG. 2.
Figure 4:
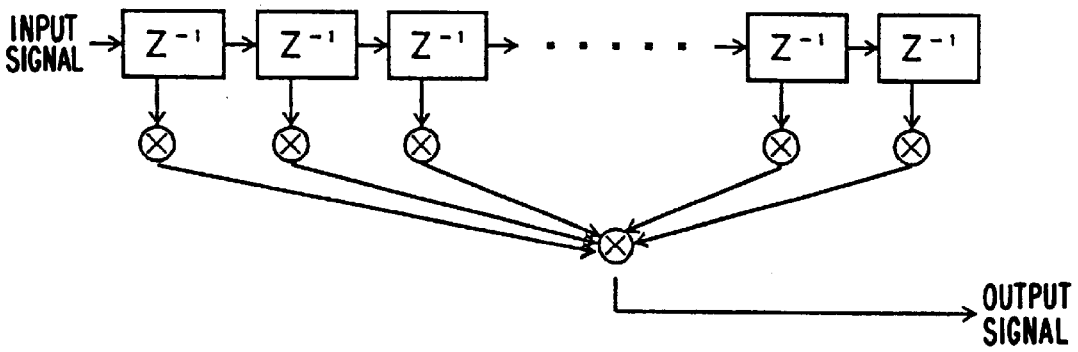
FIG. 4 PRIOR ART
FIG. 4 is a block diagram showing how the transfer function of FIG. 2 is represented by a finite impulse response (FIR) filter or a infinite impulse response (IIR) filter.
Figure 5:
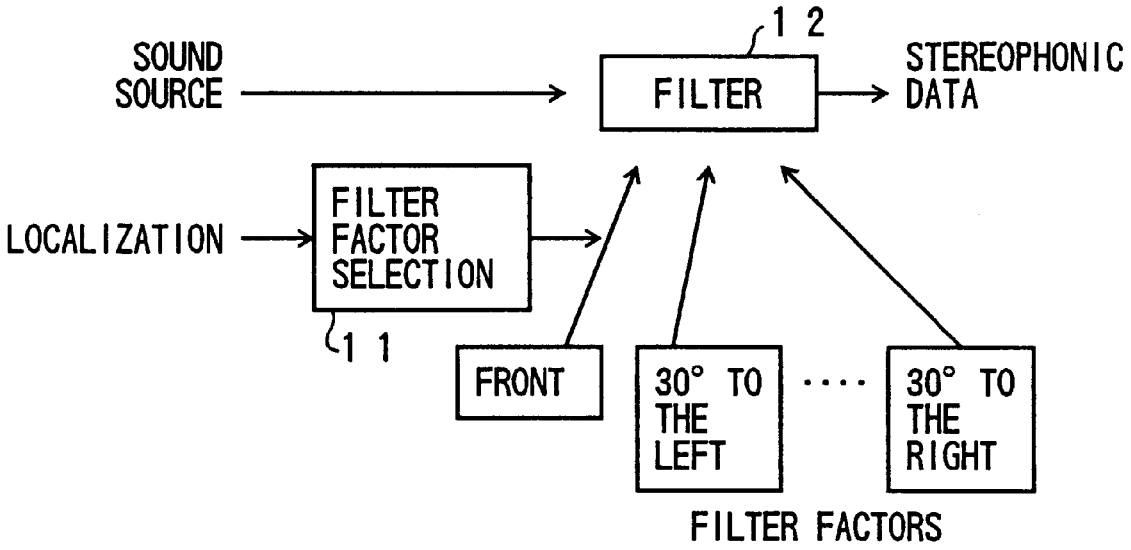
FIG. 5 PRIOR ART
FIG. 5 is a block diagram showing a construction of a stereophonic sound processing system according to the related art.
Figure 7:
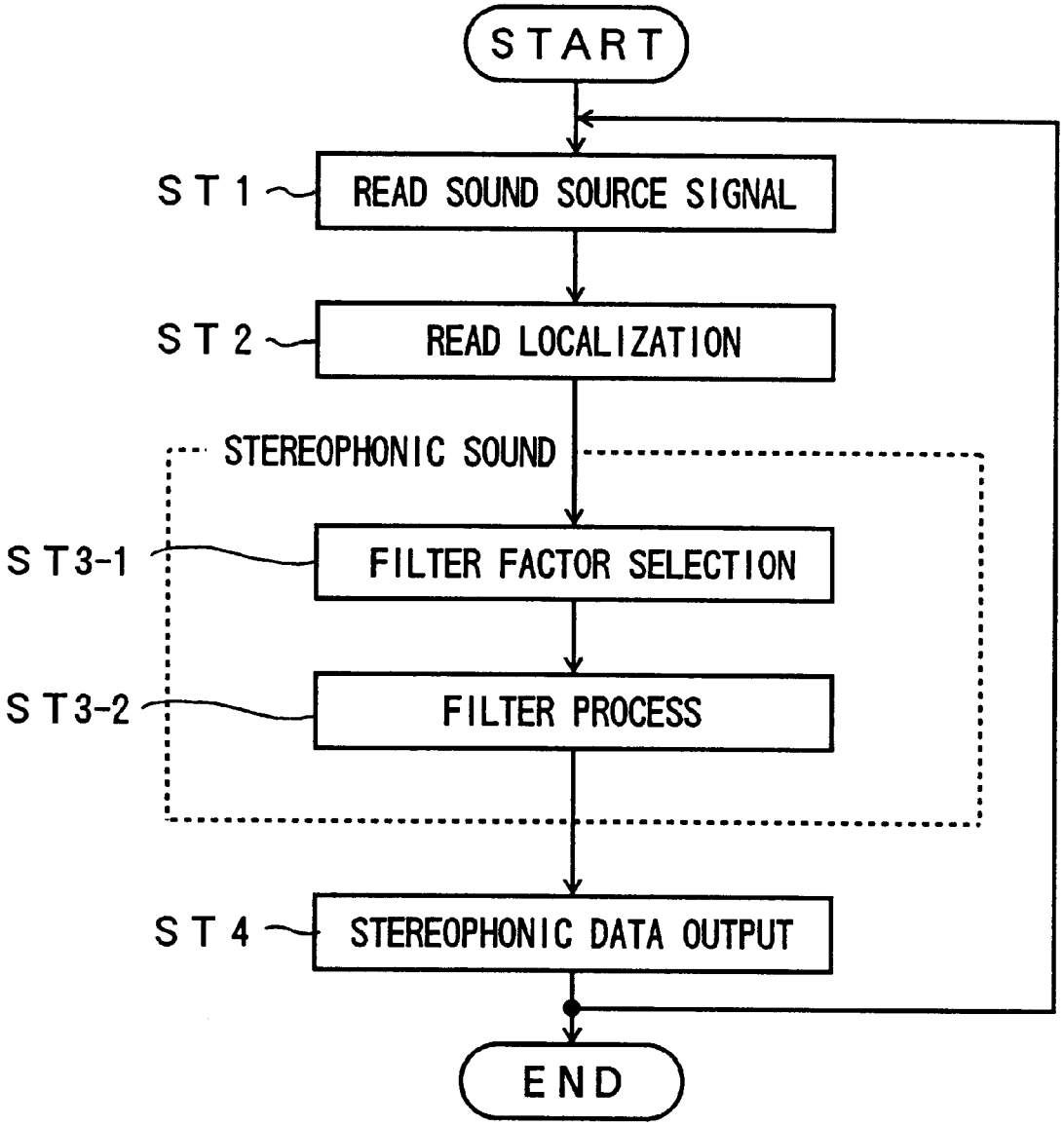
FIG. 7 PRIOR ART
FIG. 7 is a flowchart showing an operation of the stereophonic sound processing system according to the related art.
Figure 9:
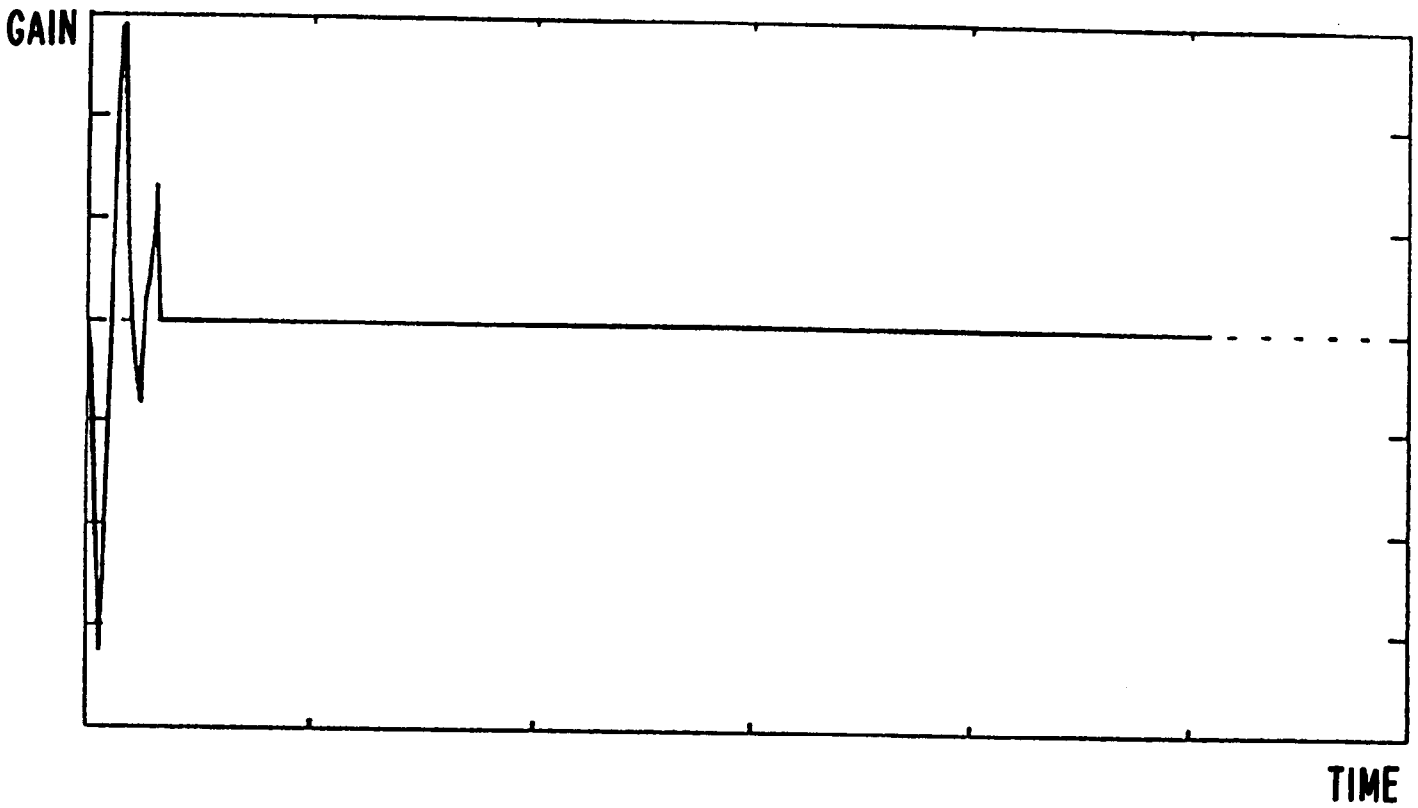
FIG. 9 is a graph showing a transfer function between a location displaced 30° to the left and a left ear simulated by the stereophonic filter means in which the number of filter taps is reduced.
Figure 10:
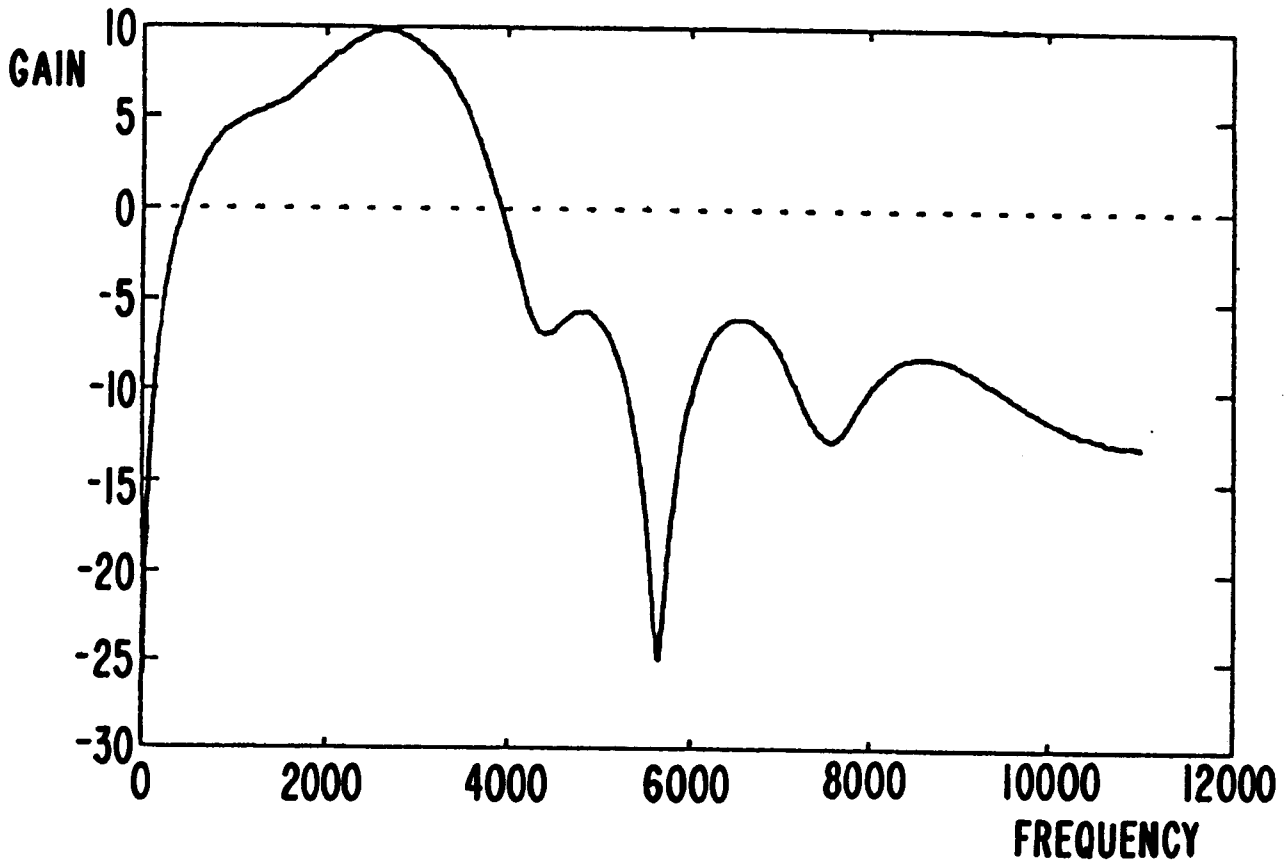
FIG. 10 is a graph showing a frequency characteristic of the transfer function of FIG. 9.

FIG. 9 is a graph showing a transfer function between a location displaced 30° to the left and a left ear simulated by the stereophonic filter means in which the number of filter taps is reduced. Comparison of the graph of FIG. 9 with that of FIG. 2 reveals that the waveform of FIG. 9 is simplified and attenuation therein occurs earlier. FIG. 10 is a graph showing a frequency characteristic of the transfer function of FIG. 9. As compared with the graph of FIG. 3, the characteristic of FIG. 10 is an approximation with a result that the precision of the resultant stereophonic sound may be poor. However, since the number of filter taps involved is significantly reduced, the processing volume is reduced. As mentioned previously, reduction of the processing volume may sometimes be useful to produce stereophonic sound efficiently.

Figure 12:
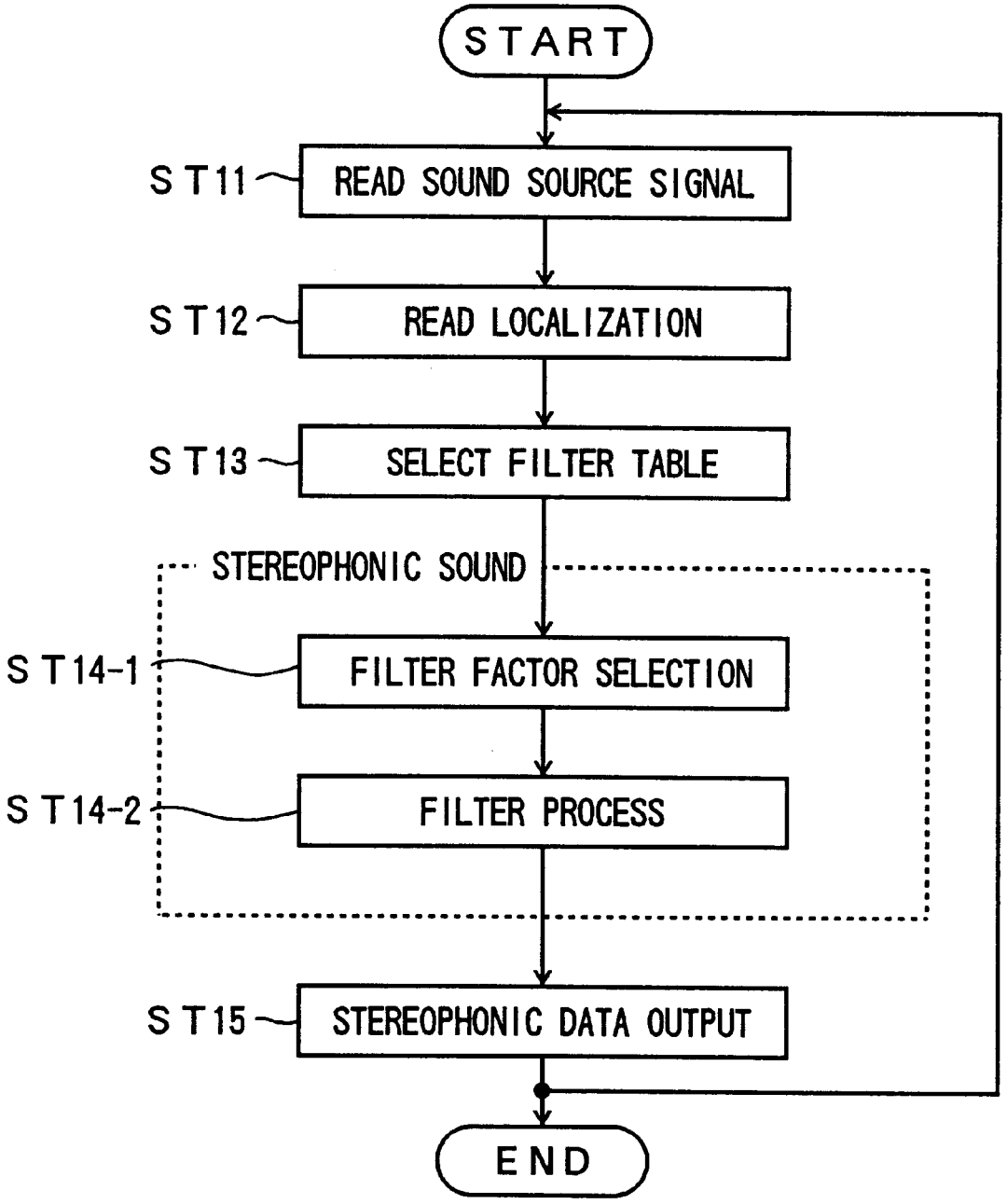
FIG. 12 is a flowchart showing an operation of the stereophonic sound processing system of FIG. 8.

FIG. 12 is a flowchart showing an operation of the stereophonic sound processing system of FIG. 8. The stereophonic sound processing system reads a signal from a sound source in step ST11. In step ST12, localization of the sound source is read. In step ST13, either the high-precision stereophonic filter means 21 or the low-precision stereophonic filter means 22 is selected in accordance with a desired factor. Selection in step ST13 corresponds to selection of the filter table 1 or the filter table 2 shown in FIG. 11.

A description will now be given of reading of localization of the sound source in step ST12. In the case of production applications such as authoring software, a producer may specify a desired location of a sound image using a pointing device such as a mouse, while observing a screen displaying an image that corresponds to stereophonic sound contained in a product being produced. The specified location is read by the production application. The localization of the sound image may be specified using numerical inputs. In the case of an end-user application (for example, a game), the localization of the sound image may be specified by a user operating an interactive input and output device. The specified localization is read by the end-user application.

In step ST14-1, the filter table provided in the selected stereophonic filter means is referred to so that the filter factor that corresponds to the localization of the sound image is selected. In step ST14-2, the filter process is executed. Selection of the filter factor is identical to selection of a filter for processing an input signal. In step ST15, the signal subjected to the filter process is output as stereophonic data, thus completing the stereophonic sound process.

While FIG. 8 shows provision of two stereophonic filter means switched to one another, finer selection is possible by providing a plurality of stereophonic filter means. A difference other than the difference in the number of taps may be introduced to effect a difference between the plurality of stereophonic filter means. For example, the input signal may be processed every two samples so that interpolation is imposed. In this case, the plurality of stereophonic filter means may have different sample processing volumes.

Figure 13:
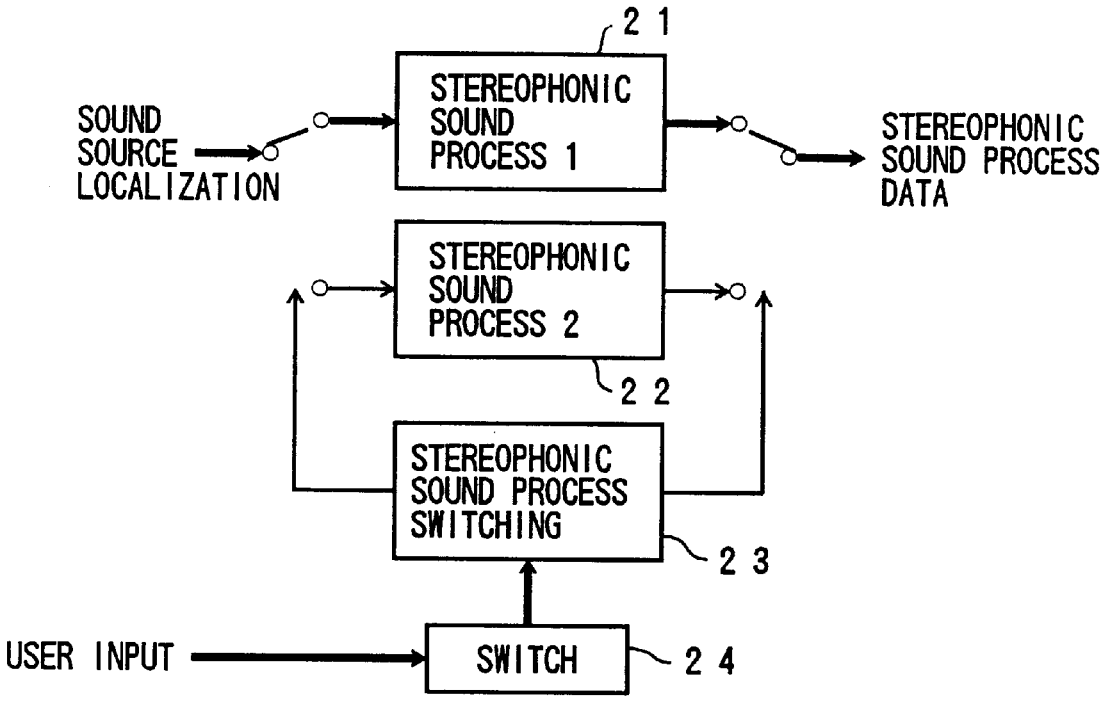
FIG. 13 is a block diagram showing a stereophonic sound processing system according to a first embodiment of the present invention.

FIG. 13 is a block diagram showing a stereophonic sound processing system according to a first embodiment of the present invention. In FIG. 13, those components that are identical to the components of FIG. 8 are designated by the same reference numerals, and the description thereof will be omitted. The system of FIG. 13 comprises a switch 24 for a user to switch between the high-precision stereophonic filter means 21 and the low-precision stereophonic filter means 22. The user operates the switch 24 to activate a switching unit 23 to select the desired stereophonic filter means. For example, a producer of stereophonic sound may use the low-precision stereophonic filter means 22 during the production so that audition can be repeated and parameter settings related to the movement of the sound image can be performed. When the parameters are finalized, high-precision stereophonic sound is produced using the high-precision stereophonic filter means 21 capable of a large processing volume.

Figure 14:
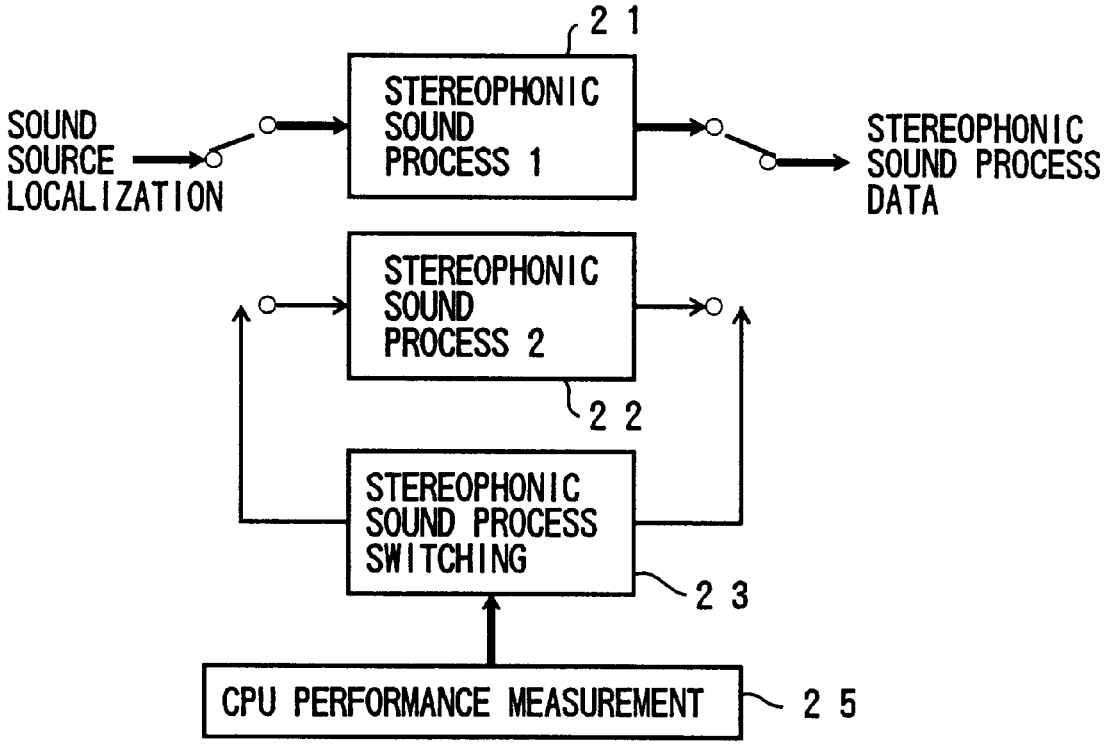
FIG. 14 is a block diagram showing a stereophonic sound processing system according to a second embodiment of the present invention.

FIG. 14 is a block diagram showing a stereophonic sound processing system according to a second embodiment of the present invention. In FIG. 14, those components that are identical to the components of FIG. 8 are designated by the same reference numerals, and the description thereof will be omitted.

Personal computers of different product models and different shipping dates may have different CPU performance. According to the second embodiment, the processing performance of a CPU is measured by a CPU performance measuring unit 25 so that an appropriate processing volume in the stereophonic sound process is selected depending on the measured performance. For example, when the CPU performance is relatively low, the processing volume is reduced by decreasing the number of taps in the filter. The result is that a real-time process that produces little stress on the part of, for example, a user of a game, at the cost of precision. From the viewpoint of a stereophonic sound producer, the arrangement of the second embodiment enables production of stereophonic sound of a desired precision adapted for an intended object and convenience of the producer.

Figure 15:
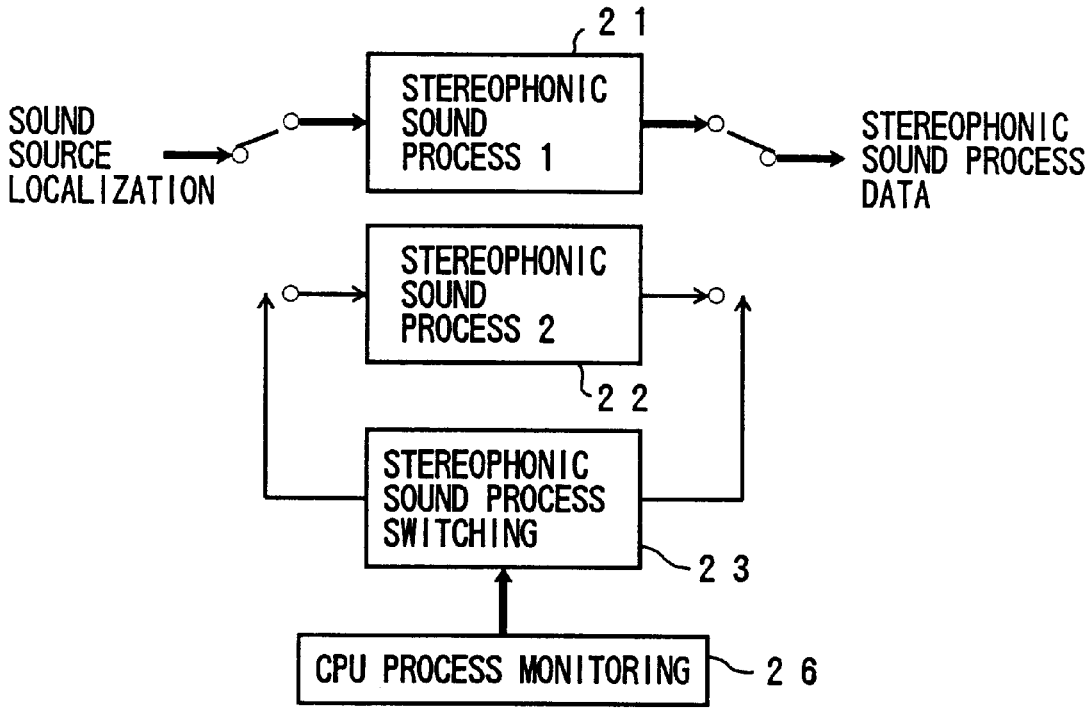
FIG. 15 is a block diagram showing a stereophonic sound processing system according to a third embodiment.

FIG. 15 is a block diagram showing a stereophonic sound processing system according to a third embodiment. In FIG. 15, those components that are identical to the components of FIG. 8 are designated by the same reference numerals, and the description thereof is omitted. In an operating system that supports multitasking, an application other than the stereophonic sound process may be running in parallel. For this reason, the process executed by the CPU is monitored by a CPU-process monitoring unit 26 so that the processing volume of the stereophonic sound process is controlled to a level that enables the stereophonic sound process to be completed in a predetermined period of time. Thus, precision of the stereophonic sound process may be reduced when there is a heavy load on the CPU and increased when the load is light.

Figure 16:
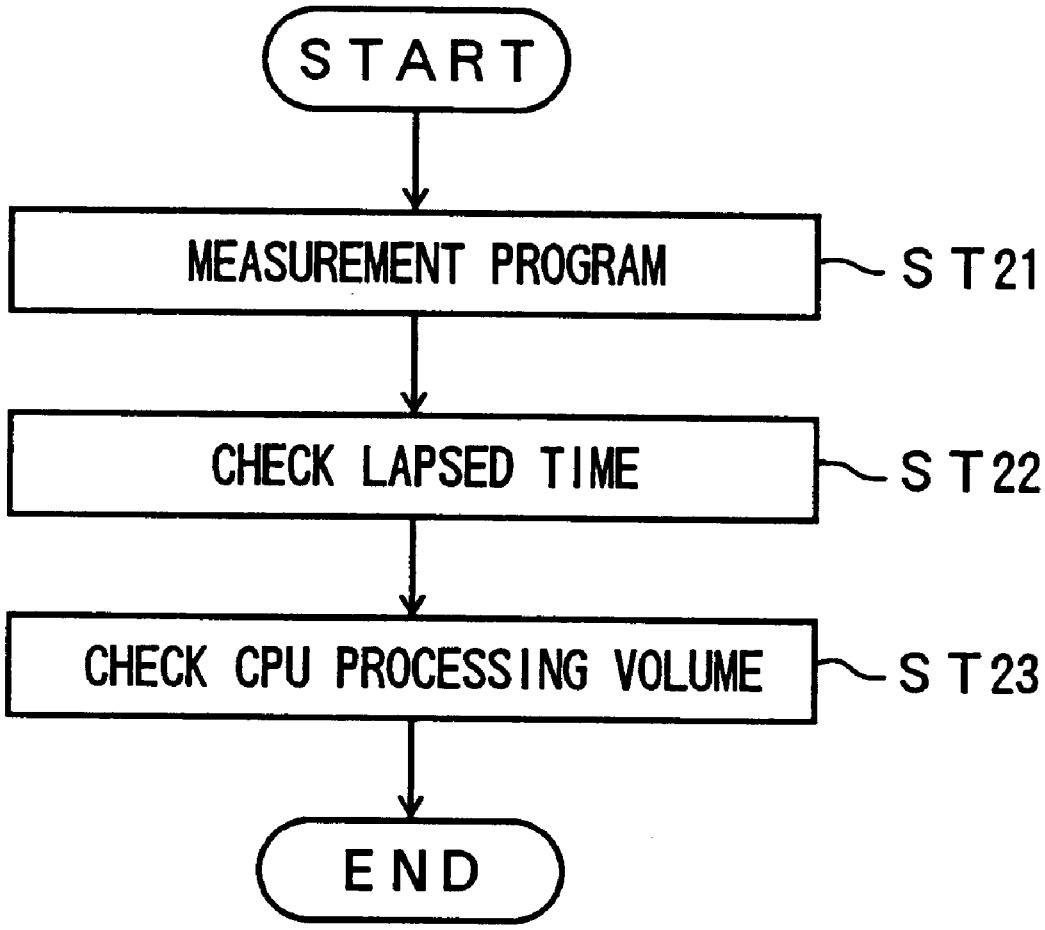
FIG. 16 is a flowchart showing an operation of monitoring the processing volume of the CPU.

FIG. 16 is a flowchart showing an operation of monitoring the processing volume of the CPU. A measurement program prepared by using a computer provided with a CPU with a known clock speed is operated (step ST21). The measurement program can monitor a relative change in the processing volume of the CPU. For example, the measurement program may provide a reference process that is completed by a Pentium 120 MHz from Intel Corporation in a reference time of 10 ms. Time required by the CPU of the stereophonic sound processing system to complete the reference process is measured (step ST22). Subsequently, a comparison is made between the time measured in step ST22 with the reference time (step ST23). Assuming that the CPU of the stereophonic sound processing system required 20 ms to complete the reference process, it is determined that the CPU can allot half the processing volume of the Pentium 120 MHz in full operation, for the stereophonic sound process. If a given stereophonic sound process assumes a processing time provided by the Pentium 120 MHz, the stereophonic sound process can be completed in the same period of time as when the Pentium 120 MHz in full operation is used to perform the stereophonic sound process, by reducing the processing volume of the stereophonic sound process to half.

FIG. 17 is a table showing filter tap numbers adapted for different CPU processing capabilities. A CPU occupancy ratio is a percentage representation of the processing capability that the CPU can allot for the stereophonic sound process. For example, Pentium 120 MHz at the CPU occupancy ratio of 20% processing an input signal from a single sound source can produce a relatively high-precision stereophonic sound using the stereophonic sound filter having 20 taps. When the number of sound sources subject to the stereophonic sound process is increased to two, the stereophonic sound process can be performed in the same processing time by changing the number of taps to 10. The CPU occupancy ratio of the Pentium 120 MHz processing the input signal from the single sound source may drop from 20% to 10%. In this case, while the number of sound sources remain unchanged, the CPU power that can be allocated to the stereophonic sound process drops so that the number of taps has to be changed to 10 in order to maintain the constant processing time.

In the case of a Pentium 75 MHz characterized by a reduced processing capability as compared with the Pentium 120 MHz, the number of taps has to be reduced in order to maintain the constant processing speed, even under the condition of the CPU occupancy ratio of 20% and the single sound source. More specifically, the number of taps may be decreased to 12, as indicated by the table.

Figure 18:
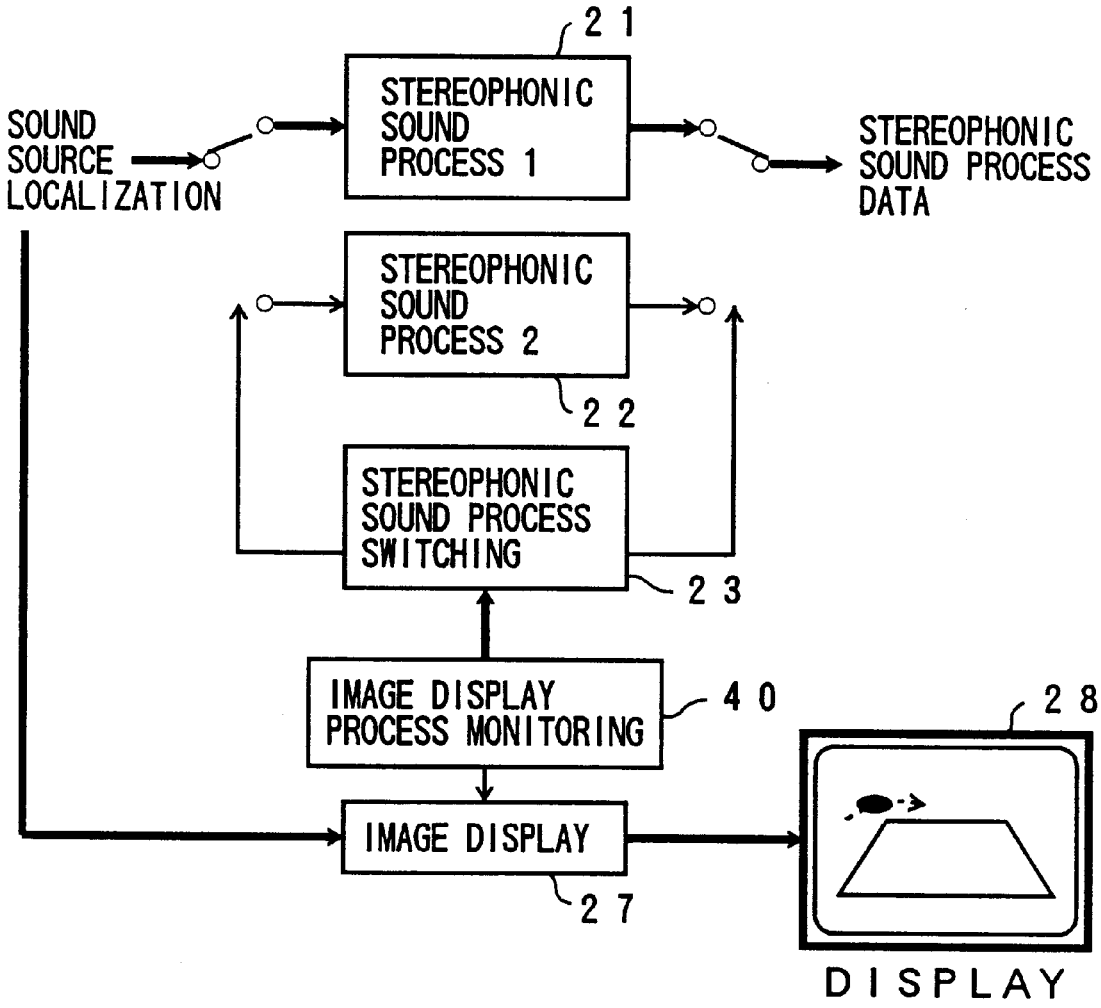
FIG. 18 is a block diagram showing a stereophonic sound processing system according to a fourth embodiment.

FIG. 18 is a block diagram showing a stereophonic sound processing system according to a fourth embodiment. In FIG. 18, those components that are identical to the components of FIG. 8 are designated by the same reference numerals, and the description thereof is omitted. The stereophonic sound processing system of FIG. 18 comprises a display 28 for displaying an image that corresponds to a sound source subject to the stereophonic sound process, an image display unit 27 for controlling the display 28, and an image display process monitoring unit 40 for monitoring the processing volume consumed for image display. The image display process monitoring unit 40 supplies information relating to the processing volume consumed for image display to the switching unit 23. The switching unit 23 switches between the stereophonic filter means depending on the information so as to control the processing volume of the stereophonic sound process. For example, when a complex image requiring fine rendering is displayed, an image displaying process consumes a large processing volume so that the processing volume of the stereophonic sound process is reduced.

Figure 19:
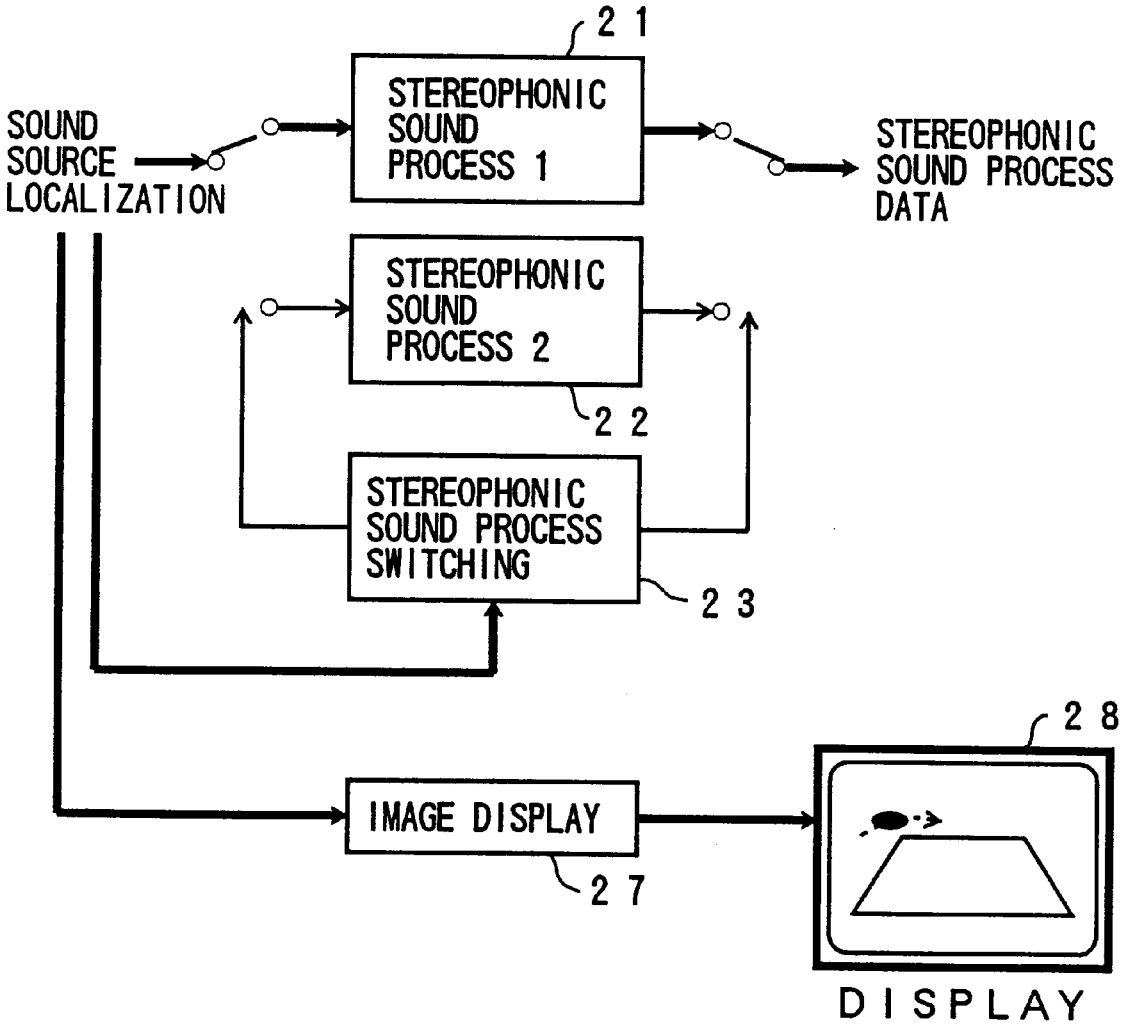
FIG. 19 is a block diagram showing a stereophonic sound processing system according to a fifth embodiment.

FIG. 19 is a block diagram showing a stereophonic sound processing system according to a fifth embodiment. In FIG. 19, those components that are the same as the corresponding components of FIG. 18 are designated by the same reference numerals, and the description thereof is omitted. Similar to the system of the fourth embodiment, the system of the fifth embodiment displays images in association with the localization of the sound image. The fifth embodiment differs from the fourth embodiment in that the switching unit 23 switches between the stereophonic filter means not in accordance with the information supplied by the image display unit 27 relating to the processing volume consumed for image display, but in accordance with the localization of the sound image. Quality of localization is improved by allocating a relatively large processing capability to image display and reducing the volume of the stereophonic sound process when the image is localized at the front of a user viewing the image, and by not displaying the image and increasing the volume of the stereophonic sound process when the image is to the back of the user. With this arrangement, the user can recognize that the sound is located to the back of the user due to the high-precision stereophonic sound. Generally speaking, localization occurring when the image is to the front is better than when the image is to the back, due to the image display. Therefore, the processing volume of the stereophonic sound process need not be raised than when the image is to the back.

Figure 20:
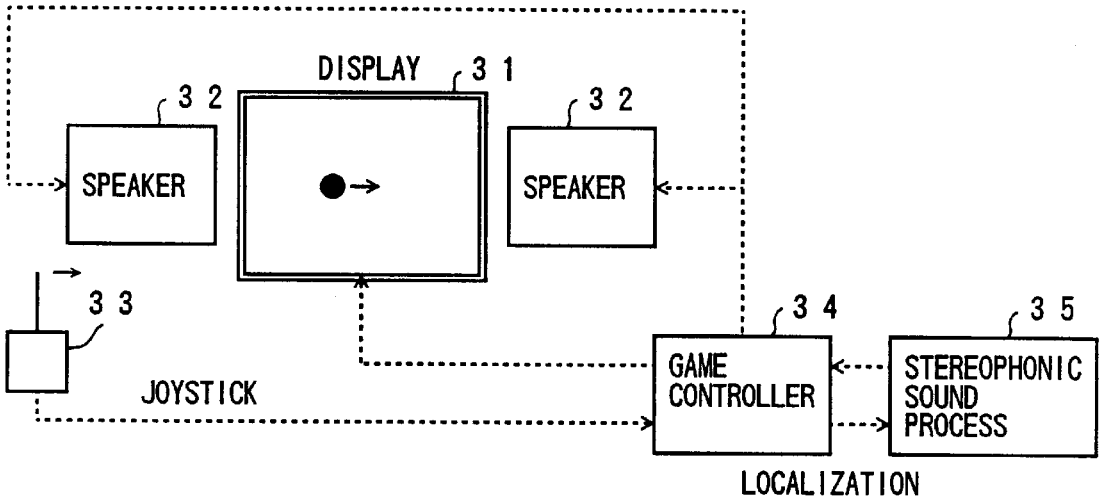
FIG. 20 is a block diagram showing a specific example for implementing the fourth embodiment shown in FIG. 18 and the fifth embodiment shown in FIG. 19.

FIG. 20 is a block diagram showing a specific example for implementing the fourth embodiment shown in FIG. 18 and the fifth embodiment shown in FIG. 19. A user moves an object on the screen of a game or the like, by operating a joystick 33 while viewing a display 31. Positional information relating to the position of the object is supplied to a stereophonic sound processing device 35 via a game controller 34 (more specifically, a personal computer). The stereophonic sound processing device 35 performs a stereophonic sound process on the basis of the positional information so as to output a rich sound effect to a speaker 32.

Figure 21:
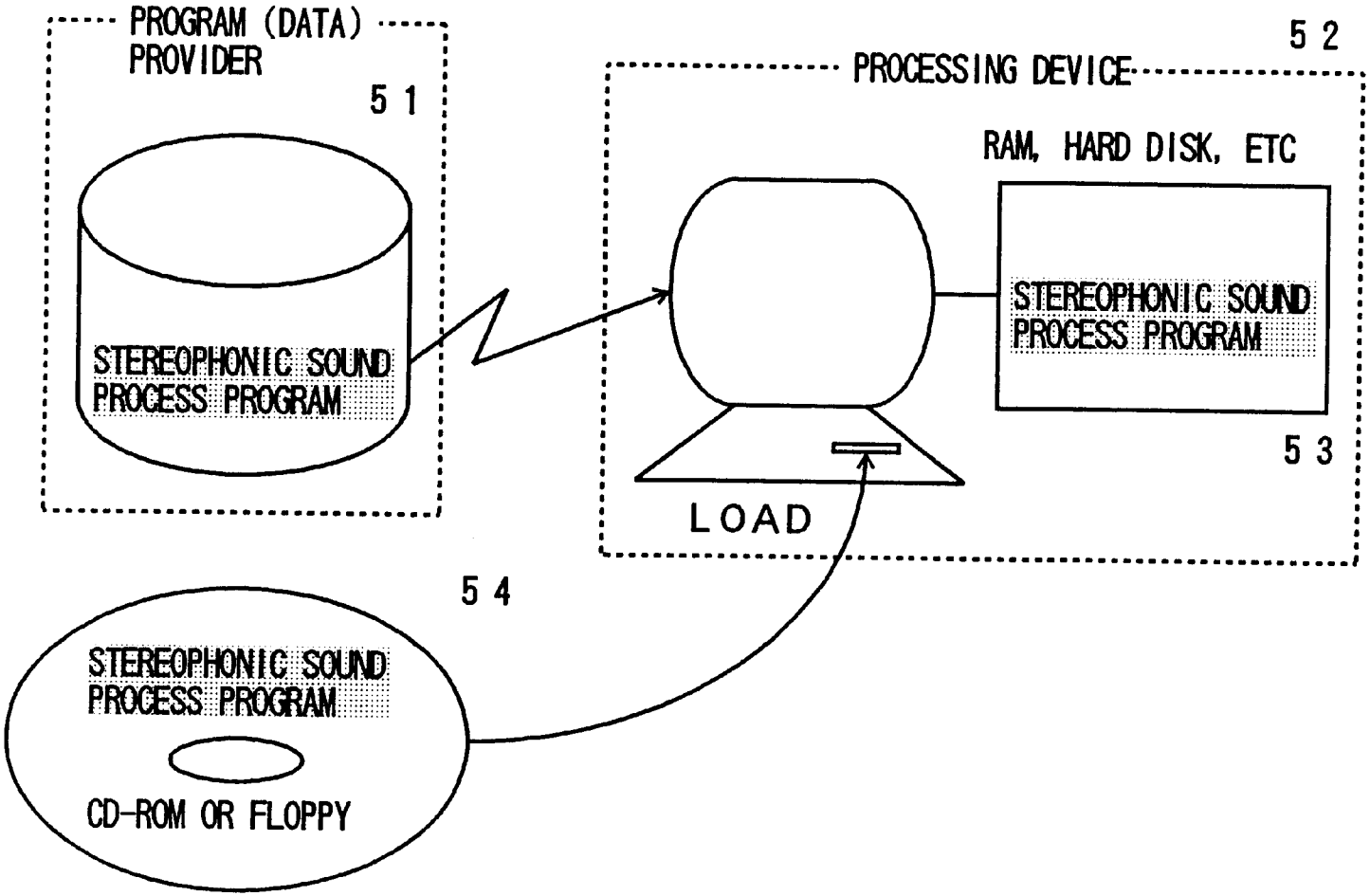
FIG. 21 shows how a recording medium storing a stereophonic sound processing program according to the present invention can be implemented.

FIG. 21 shows how a recording medium storing a stereophonic sound processing program according to the present invention can be implemented. The recording medium as claimed in claim 11 of the present invention may be a memory 51 of a program provider connected to a network, a storage device 53 (RAM, hard disk, etc.) that constitutes a processing device 52 for performing a stereophonic sound process, or a removable recording medium 54 accessed by the processing device 52. In any case, the stereophonic sound processing program (a production application or an end-user application such as a game) stored in the recording medium is loaded to a main memory of the processing device 52 so as to be executed thereby.

Figure 22:
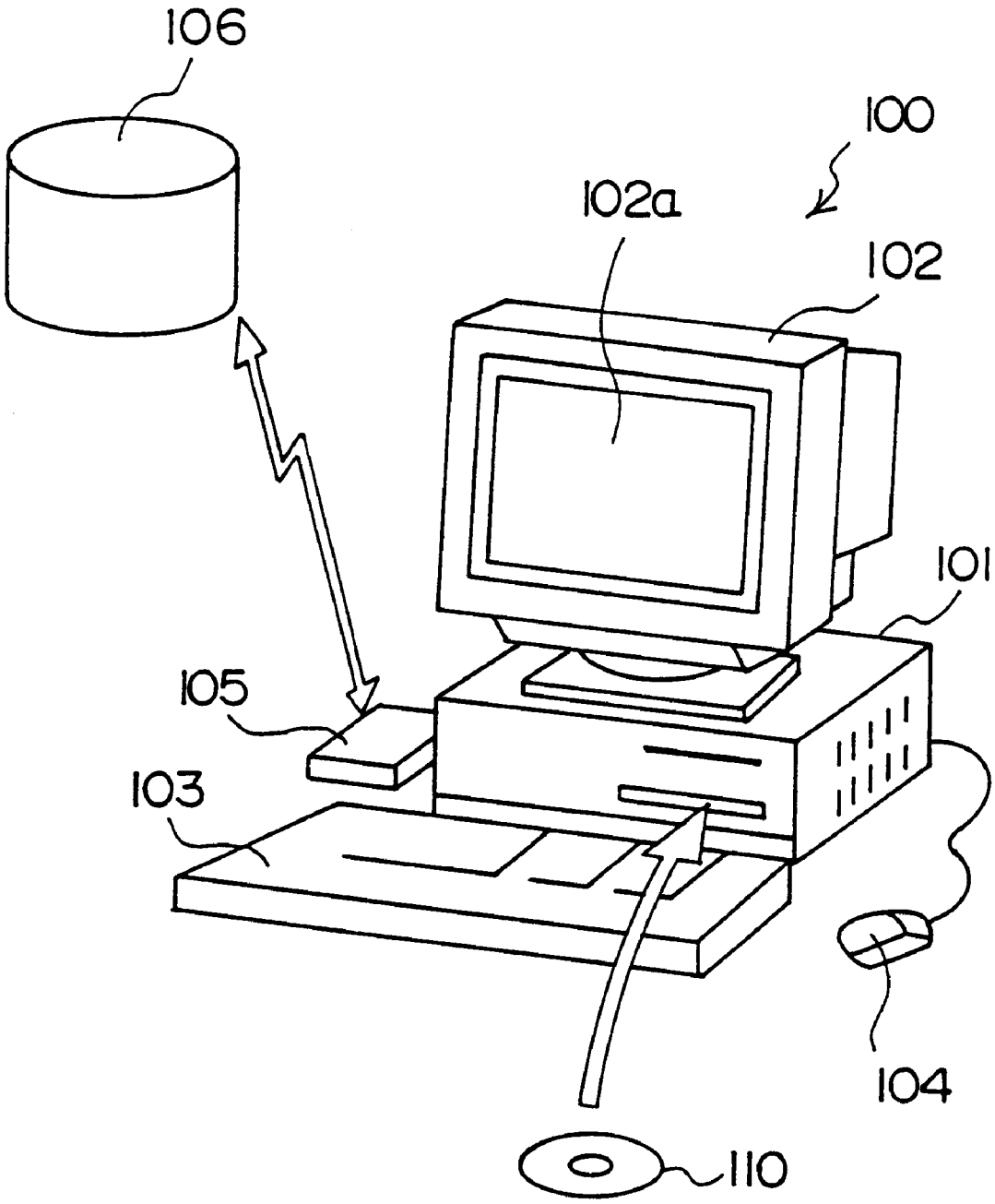
FIG. 22 shows how the program is loaded from a computer-readable recording medium according to the present invention and is executed.

FIG. 22 shows how the program is loaded from a computer-readable recording medium according to the present invention and is executed. The computer system 100 shown in FIG. 22 comprises a main unit 101 having a CPU, a disk drive unit and the like built therein, a display 102 for displaying images in accordance with instructions from the main unit 101, a keyboard 103 for supplying various information to the computer system 100, a mouse 104 for specifying desired locations on a screen 102*a* of the display 102, and a modem 105 for accessing an external database 106. The stereophonic sound processing program stored in a removable recording medium such as a disk 110 or downloaded from the external database via the modem 105 or stored in the hard disk built into the main unit 101 is supplied to the computer system 100 and is executed thereby.

While the embodiments described above assume that a CPU of a personal computer is used to implement the processing means for controlling the stereophonic filter means so as to generate stereophonic sound, the processing means may be implemented by any signal processing device such as a DSP. Switching between the FIR filters having different numbers of taps is effected by changing the number of times by which a process for reading a filter factor from the filter table and performing a product-sum operation is operated.

The present invention is not limited to the above-described embodiments, and variations and modifications may be made without departing from the scope of the present invention.

What is claimed is:

1. A stereophonic sound processing system for localizing a sound image at desired locations using devices including a headphone or a speaker, said system comprising:

a processor which generates stereophonic sound on the basis of an input signal;

a plurality of stereophonic filters each comprising an FIR filter having a respective number of taps and which processes an input signal, each of said plurality of stereophonic filters having a respective different sound precision determined by the respective number of said taps; and a switching unit which selects one of said plurality of stereophonic filters in accordance with a desired factor regarding the sound precision and a processing volume of said processor;

wherein said processor controls the selected stereophonic filter so as to generate the stereophonic sound based on the processed input signal supplied by the selected stereophonic.

2. The stereophonic sound processing system as claimed in claim 1, wherein said processor further comprises a second plurality of stereophonic filters each comprising an IIR filter.

3. The stereophonic sound processing system as claimed in claim 1, wherein said processor is dedicated to performing generation of the stereophonic sound.

4. The stereophonic sound processing system as claimed in claim 1, wherein said processor concurrently performs a process other than generation of the stereophonic sound.

5. The stereophonic sound processing system as claimed in claim 1, wherein said switching unit receives a user input to select one of said plurality of stereophonic filters.

6. The stereophonic sound processing system as claimed in claim 1, wherein said desired factor is a number of sound sources.

7. The stereophonic sound processing system as claimed in claim 1, further comprising a processor performance measuring unit which measures a performance of said processor, wherein one of said plurality of stereophonic filters is selected in accordance with a measured performance of said processor.

8. The stereophonic sound processing system as claimed in claim 1, further comprising a process monitoring unit which monitors a process executed by said processor, wherein one of said plurality of stereophonic filters is selected depending on a processing load imposed on said processor as a result of concurrently executing a process other than generation of stereophonic sound.

9. The stereophonic sound processing system as claimed in claim 1, further comprising a stereoscopic image displaying apparatus which displays a stereoscopic image in accordance with a stereoscopic image process concurrently with generation of the stereophonic sound, wherein one of said plurality of stereophonic filters is selected depending on a volume of the sterophonic image process.

10. The stereophonic sound processing system as claimed in claim 1, wherein a filter factor of each of said plurality of stereophonic filters is selected depending on a localization of a sound image.

11. A computer-readable recording medium storing a stereophonic sound processing program for localizing a sound image at desired locations using devices including a headphone and a speaker, said stereophonic sound processing program comprising instructions which require a processor to generate stereophonic sound on the basis of an input signal;

said processor comprising:

a plurality of stereophonic filters each comprising one of a FIR filter and an IIR filter which processes an input signal wherein each filter comprises a number of taps which determines a sound precision; and a switching unit which selects one of said plurality of stereophonic filters in accordance with a desired factor regarding the sound precision and a processing volume of the processor; wherein said processor controls the selected stereophonic filter so as to generate stereophonic sound on the basis of a filtered result supplied by the selected stereophonic filter.

12. A stereophonic sound processing system for localizing a sound image at desired locations using a headphone or a speaker, comprising:

a processor which generates stereophonic sound on the basis of an input signal;

a plurality of stereophonic filters each comprising one of a FIR filter and an IIR filter which process the input signal, each of said plurality of stereophonic filters having respective different sound precisions determined by a number of taps of said filter; and a filter selector which receives a control signal regarding the sound precision and a processing volume of said processor and selects one of said plurality of stereophonic filters in response to the control signal.

13. The stereophonic sound processing system as claimed in claim 12, wherein said sound processing system further comprises:

a processing load monitor which monitors a signal processing load of the processor and outputs the control signal based on the signal processing load.

14. The stereophonic sound processing system as claimed in claim 12, wherein said system further comprises an image display monitor which monitors a processing volume consumed by concurrent display of a visual image and outputs the control signal based on a complexity of said image.

15. The stereophonic sound processing system as claimed in claim 12, wherein said control signal is provided by user input.

16. A stereophonic sound processing system for localizing a sound image at desired locations using devices including a headphone or a speaker, said system comprising:

a processor;

a first stereophonic filter implemented by the processor and having a first sound precision determined by a first number of taps of said first stereophonic filter, the first stereophonic filter adapted to receive an input signal and to output left and right signals;

a second stereophonic filter implemented by the processor and having a second sound precision greater than the first sound precision and determined by a second number of taps of said second stereophonic filter, the second stereophonic filter adapted to receive the input signal and output the left and right signals; and a processor performance measuring unit which measures a processing volume of the processor and selects one of the first and second filters to output the left and right signals based on the measured processing volume of the processor.

17. A stereophonic sound processing system for localizing a sound image at desired locations using devices including a headphone or a speaker, the system comprising:

a processor;

a stereophonic filter implemented by the processor which receives an input signal and outputs left and right signals each signal having one of a first sound precision and a second sound precision, the second sound precision being greater than the first sound precision, wherein the first and second sound precisions are determined by a first and second number of taps of the stereophonic filter, respectively; and a processor performance measuring unit which measures a processing volume of the processor and selects one of the first and second sound precisions based on the measured processing volume of the processor.

* * * * *

UNITED STATES PATENT AND TRADEMARK OFFICE

CERTIFICATE OF CORRECTION

PATENT NO. : 6,343,130 B2
DATED : January 29, 2002
INVENTOR(S) : Yasushi Yamazaki It is certified that error appears in the above-identified patent and that said Letters Patent is hereby corrected as shown below:

Column 10,
Line 26, after "provided by" insert -- a --.

Signed and Sealed this

Sixth Day of May, 2003

JAMES E. ROGAN
*Director of the United States Patent and Trademark Office*